United States Patent [19]

Croley

[11] 4,043,502

[45] Aug. 23, 1977

[54] PACKING, SHIPPING, AND SIDE-DISPENSING CONTAINER FOR DENSE MATERIAL

[75] Inventor: Thomas E. Croley, Worthington, Ohio

[73] Assignee: Corco, Inc., Worthington, Ohio

[21] Appl. No.: 718,582

[22] Filed: Aug. 30, 1976

[51] Int. Cl.[2] ..... B65D 5/72; B65D 5/48

[52] U.S. Cl. ..... 229/17 B; 222/528; 229/23 BT

[58] Field of Search ..... 229/23 BT, 14 BW, 15, 229/17 B; 222/528, 88; 214/304

[56] References Cited

U.S. PATENT DOCUMENTS

| | | | |
|---|---|---|---|
| 2,799,440 | 7/1957 | Frederich et al. | 229/23 BT X |
| 3,193,152 | 7/1965 | White, Jr. | 229/17 B X |
| 3,207,380 | 9/1965 | Hennessey | 229/17 B X |
| 3,207,412 | 9/1965 | Bronte et al. | 229/17 B |
| 3,633,794 | 1/1972 | Croley | 222/88 |
| 3,701,466 | 10/1972 | Woodrow et al. | 229/17 B |
| 3,957,179 | 5/1976 | Bamburg | 222/528 |

FOREIGN PATENT DOCUMENTS

| | | | |
|---|---|---|---|
| 1,038,639 | 8/1966 | United Kingdom | 229/23 BT |

*Primary Examiner*—Davis T. Moorhead
*Attorney, Agent, or Firm*—Wm. V. Miller

[57] ABSTRACT

A corrugated container consisting mainly of a lower tray with upright peripheral flanges, upright liner tubes disposed side-by-side on the tray to form a pair of material-receiving chambers, and a surrounding outer shell or tube enclosing the liner tubes, the tubes being interlocked with the tray for maximum strength. A side-dispensing arrangement is provided which includes outwardly-displaceable tabs in the respective liner side walls, outer tube side wall, and flanges of the tray, whereby it is possible, when desired, to form a dispensing passage leading laterally from the lower ends of the material chambers.

4 Claims, 14 Drawing Figures

PACKING, SHIPPING, AND SIDE-DISPENSING CONTAINER FOR DENSE MATERIAL

BACKGROUND OF THE INVENTION

Corrugated containers of the general type disclosed in my U.S. Pat. No. 3,633,794 have been provided for packing, shipping and dispensing bulk material. This type of container is provided with a special bottom structure that has a tear strip to open the bottom for dispensing. However, for packing and dispensing many bulk materials, such as slugs, washers, nuts and other dense small objects or particles, it is desirable to dispense from the side of the container, at its lower end for feeding into counting or other machines, rather than from the bottom. Attempts have been made to provide a suitable side-dispensing corrugated container for bulk materials but these usually have special gate-valves of different material, such as metal, which are difficult to incorporate in the corrugated wall, and, therefore, are relatively costly.

SUMMARY OF THE INVENTION

This invention provides a corrugated container which is of sufficient strength to pack and ship dense bulk materials, such as coins or small metal parts. It includes a main outer shell or tube enclosing a pair of liner tubes which are disposed upright side-by-side to form two material-receiving chambers, all the tubes resting on and interlocking with a lower tray having upright flanges, to give a strong bottom structure as well as a container with side walls which will not tend to bulge under load. A side-dispensing structure is provided whereby the contents of the two chambers can be dispensed simultaneously. This includes aligning apertures at the lower outer common corners of the two liner tubes, whereby the two chambers are in communication, outwardly-displacable tabs in the adjacent outer corner walls of the liner tubes, and outwardly-displacable tabs in the side wall of the outer shell and in the upright flanges of the tray, so that when all these tabs are displaced, there is a dispensing passage leading laterally outwardly from the lower ends of the inner chambers so as to dispense the contents thereof.

Although corrugated board is preferred, the container may be formed of any other suitable fiberboard. It is preferably of quadrangular form but this invention could be incorporated in containers of other shapes.

BRIEF DESCRIPTION OF THE DRAWINGS

The best mode contemplated in carrying out this invention is illustrated in the accompanying drawings in which.

DETAILED DESCRIPTION OF THE INVENTION

Figure 1:
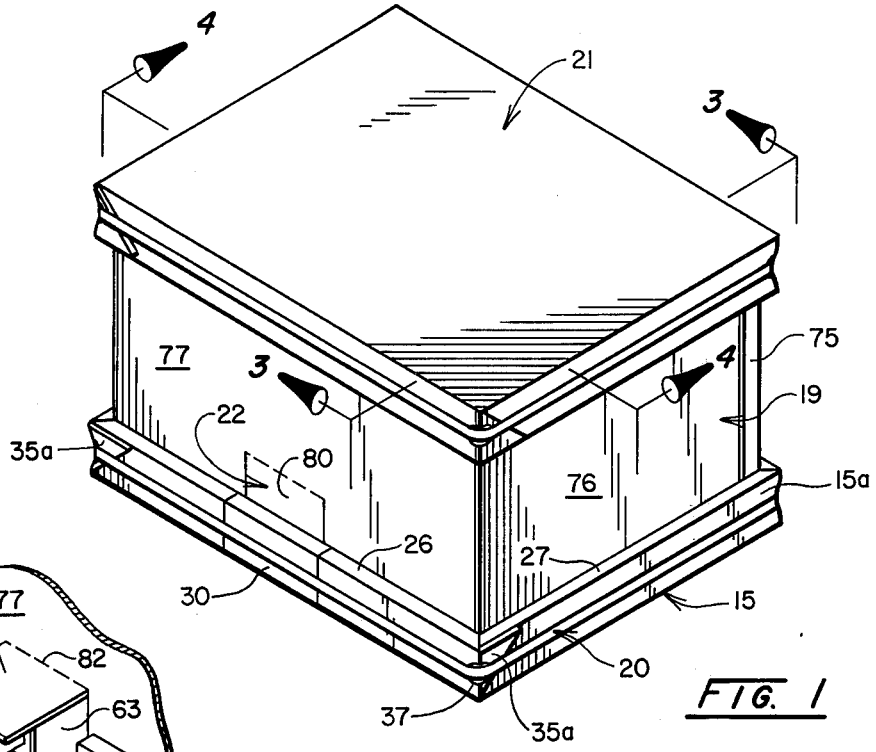
FIG. 1 is a perspective view of the assembled container.

The container assembly of this invention is shown in FIGS. 1 to 13 as being rectangular in both horizontal and vertical cross-section but it need not be this specific shape. The dispensing arrangement of this invention may be incorporated in the side wall of containers of other shapes. It is preferred that the container be formed mainly of corrugated board but other fiberboards or similar materials may be used.

The container assembly is shown as consisting mainly of a lower tray 15 with upright peripheral flanges, a pair of upright liner tubes or shells 16 and 17 disposed side-by-side, preferably on a liner pad 18, in the tray, and an outer upright shell or tube 19 enclosing the liner tubes and having its lower end disposed within the tray. This assembly is held together in cooperative relationship by means of a tie-band or strip 20. A cap structure 21, identical with the tray 15 or of other suitable form, is also provided. An outwardly displaceable tab structure is provided in one of the side walls of the assembly whereby a side-dispensing passage may be formed when desired, and this structure is indicated generally by the numeral 22.

Figure 7:
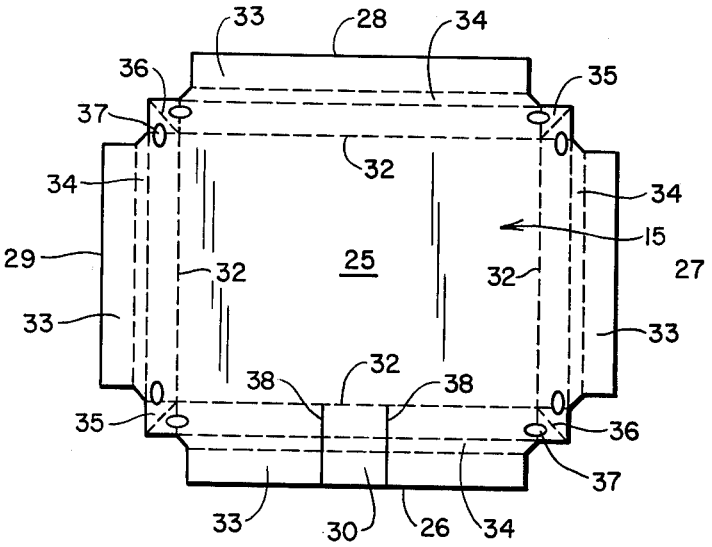
FIG. 7 is a plan view of the scored, slit and cut blank used in producing the bottom tray.
Figure 8:
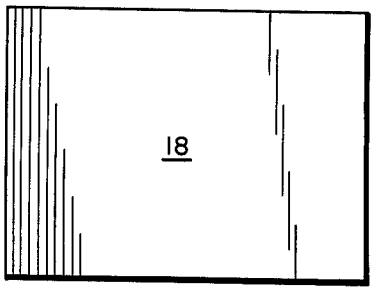
FIG. 8 is a plan view of the bottom pad used in the tray.

The tray 15 is formed from the blank shown in FIG. 7 which is produced from a single rectangular sheet of material by cutting, slitting and scoring. It includes the central bottom panel 25 which has the four double-flange flaps 26, 27, 28 and 29 projecting outwardly therefrom. All of the flanges are identical except that the flange 26 has a tab 30 formed therein midway of its length. Each flange flap includes an inner section 31, hinged to the panel 25 at a score line 32, and an outer section 33, hinged to the inner section at a double score line 34. All the adjacent inner sections 31 are connected together by square corner sections 35 which are hinged thereto by continuations of the respective score lines 32 and each of which is provided with a scored diagonal fold line 36. Each corner section, at the score lines 32, is provided with an oval slot 37 extending across the line with its long axis at a right angle thereto. The tab 30 in the flap 26 is formed by parallel slits 38 extending inwardly from the outer edge of the outer section 33 to the flap hinge line 32.

The bottom liner panel or blank 18, as shown in FIG. 7 is of rectangular form and of an area the same as panel 25 of the tray blank.

Figure 9:
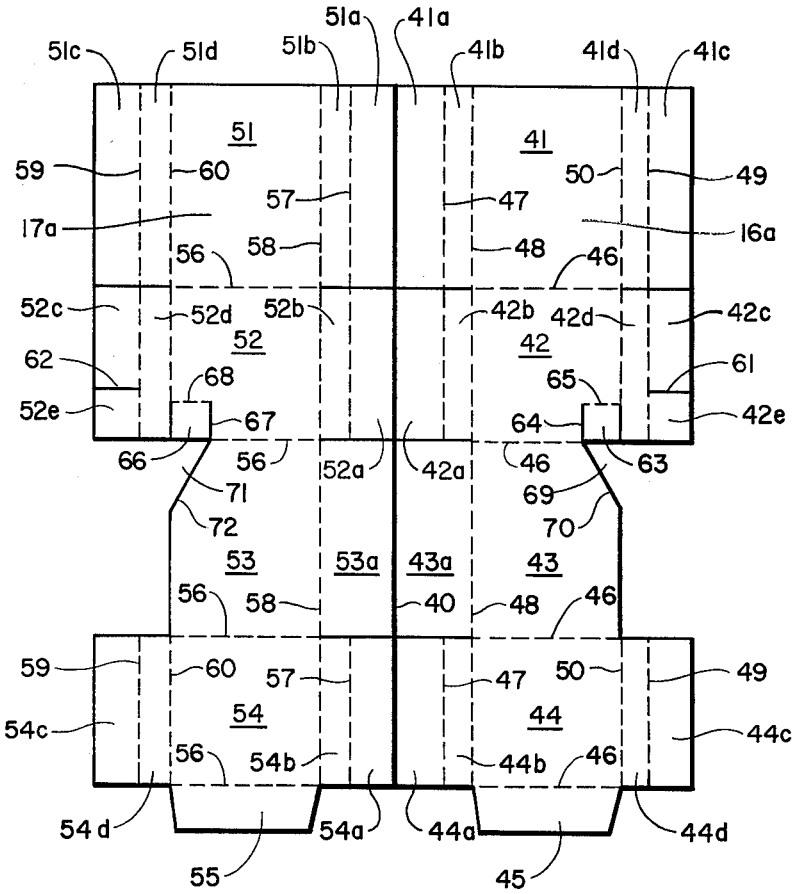
FIG. 9 is a plan view of the scored, slit and cut blank used in producing the two inner liner tubes.

The liners 16 and 17 are formed from the double blank shown in FIG. 9 which is produced from a rectangular sheet of material by cutting, slitting, and scoring as indicated the separate blanks 16*a* and 17*a* for the liners 16 and 17 being subsequently produced by cutting at the horizontal median line 40. The separated blanks 16*a* and 17*a* will be identical except one will be for the right-hand end of the container and the other for the left-hand end, due to the necessary reversal of the dispensing tab structure formed therein. The blank 16*a* includes the sidewall panels 41, 42, 43 and 44 and the connector flap 45 hinged together at the respective score lines 46. The blank 17*a* is similarly formed to include the sidewall panels 51, 52, 53 and 54 and the connector flap 55 hinged together at the respective score lines 56.

The panels 41 and 42 have the respective upper flaps 41*a* and 42*a* hinged by score lines 47 to the respective connector sections 41*b* and 42*b* which, in turn, are hinged by score lines 48 to the panels. These panels 41 and 42 have similar lower flange flaps 41*c* and 42*c*, hinged at the score lines 49 to the respective connector sections 41*d* and 42*d* which, in turn, are hinged by score lines 50 to the panels. The panels 51 and 52 have the upper flaps 51*c* and 52*c* and the lower hinge flaps 51*a* and 52*a* similarly formed with the connector sections 51*d* and 52*d* by the score lines 57 and 58 and the score lines 59 and 60 which produce the connector sections 51*b*, 52*b*, 51*d* and 52*d*. The flap 42*c* has a tab 42*e* produced therein by a slit 61 at right angle to score line 49. Similarly, the flap 52*c* has tab 52*e* formed therein by a slit 62 at a right angle to score line 59. Wall panel 42 has a tab 63 provided by parallel slits 64 extending inwardly to a scored hinge line 65, one slit aligning with score line 50. Similarly, wall panel 52 has the tab 66 provided by slits 67 extending inwardly to scored hinge line 68, one slit aligning with score line 60. The sidewall panels 43 and 53 have lower flange flaps 43*a* and 53*a*, respectively, formed thereon, which are hinged at the score lines 48 and 58, but have no upper flaps. The panels 43 is provided with a notch 69 at the hinge line 46, where it is connected to panel 42, by a cut 70 which angles from the outer or lower edge of panel 43 to the slot 64. Similarly, the panel 53 is provided with a notch 71, at the hinge line 56, by a cut edge 72 which angles from the outer or lower edge of panel 53 to the slit 67. The panels 44 and 54 have respectively formed thereon the flange flaps 44*a*, 44*c*, 54*a* and 54*c* and the connector flaps 44*b*, 44*d*, 54*b* and 54*d*, produced in the same manner as the previously described flaps.

Figure 10:
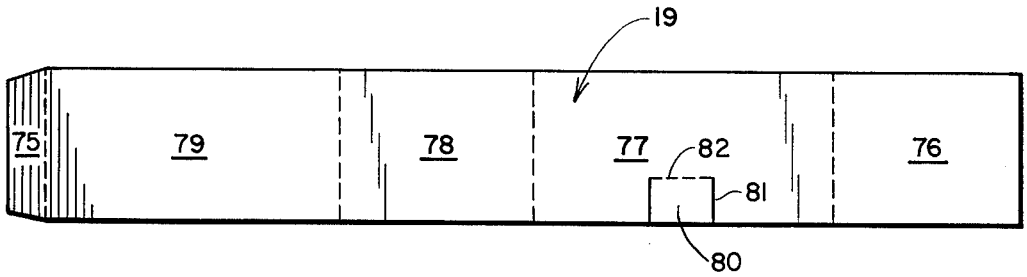
FIG. 10 is a plan view of the scored blank used in producing the outer tube.

The shell 19 is formed from the blank shown in FIG. 10. This blank includes the vertical scored hinge lines 74 which produce the connector flap 75 and the four sidewall panels 76, 77, 78, and 79. The lower edge of the panel 77 has the tab 80 produced therein by the panel vertical slits 81 which extend from such edge inwardly to the scored hinge line 82.

The tie member 20 may be a flexible band, tape, wire, strap, etc., which may be readily passed around and tightened on the upstanding flange 15*a* of the bottom tray 15. It may be of metal, plastic, cloth, or other material, but is preferably a metal band as shown.

Figure 1A:
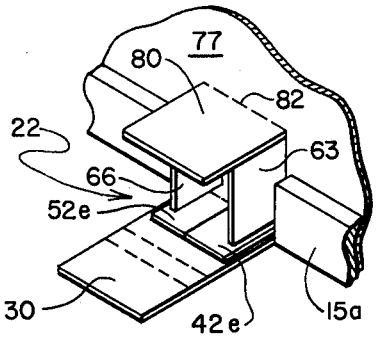
FIG. 1*a* shows the side-despensing structure in open condition.
Figure 3:
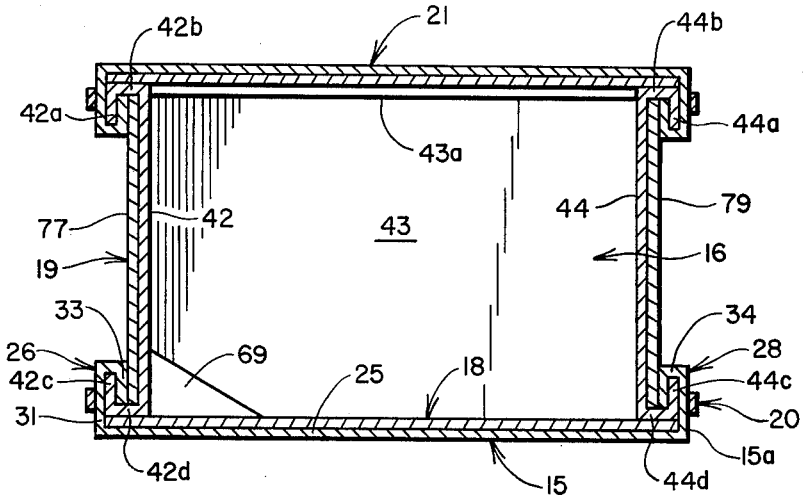
FIG. 3 is a vertical sectional view taken along line 3—3 of FIG. 1.
Figure 4:
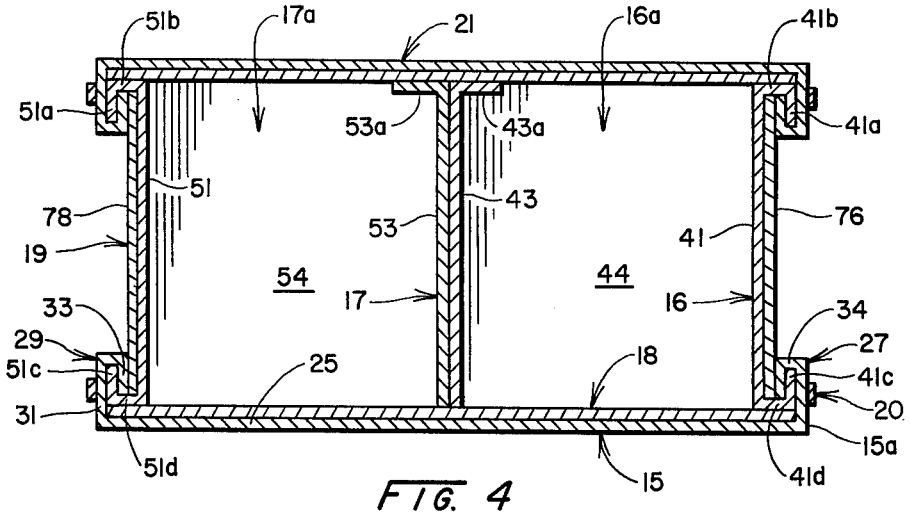
FIG. 4 is a similar view taken on line 4—4 of FIG. 1.
Figure 5:
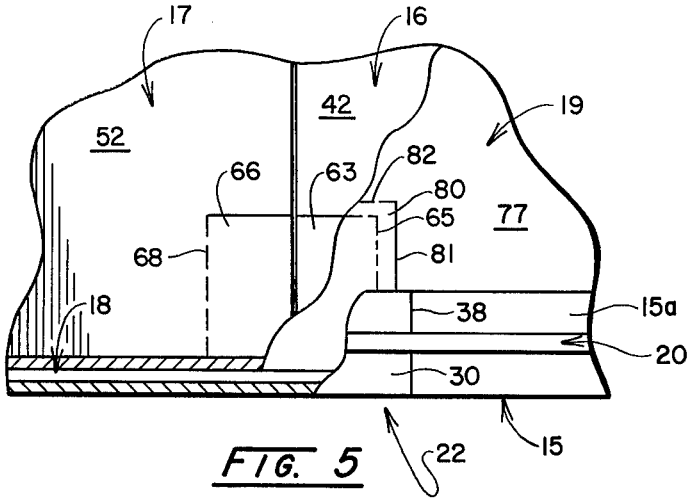
FIG. 5 is a detail of the structure which provides the side-dispensing opening when desired.
Figure 6:
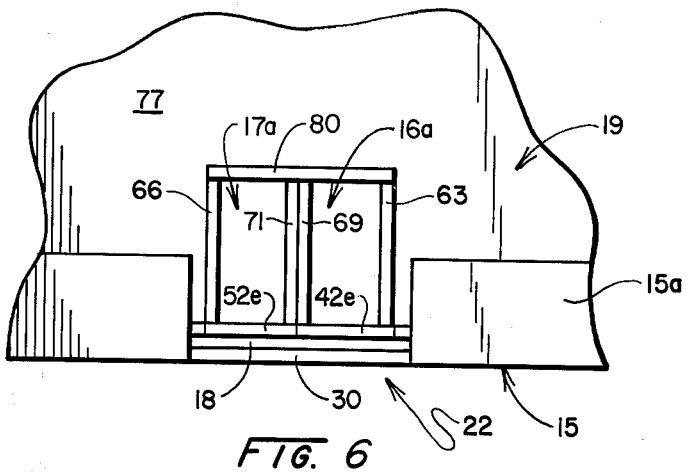
FIG. 6 is a similar view showing the structure in dispensing condition.
Figure 11:
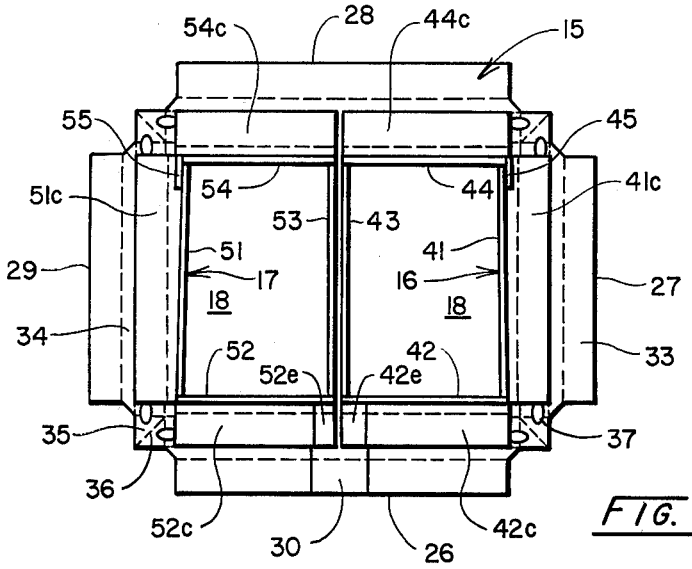
FIG. 11 is a schematic plan view showing the two inner liner tubes positioned on the bottom tray blank and bottom liner pad.
Figure 12:
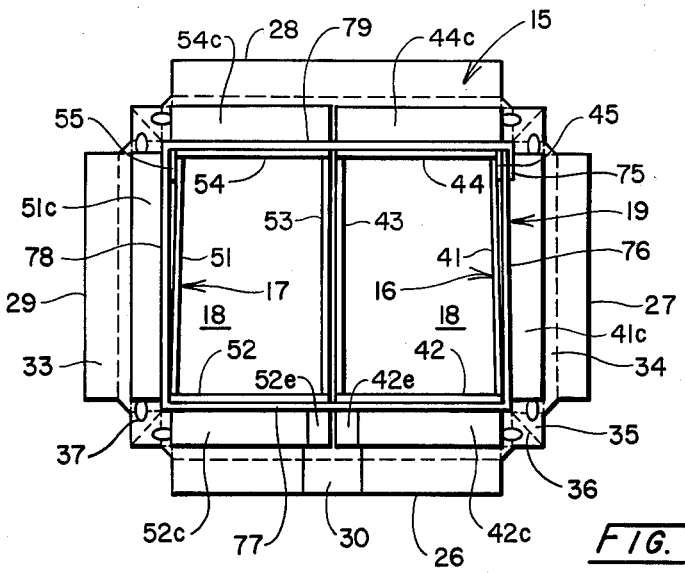
FIG. 12 is a similar view showing the outer tube positioned over the liner tubes.
Figure 13:
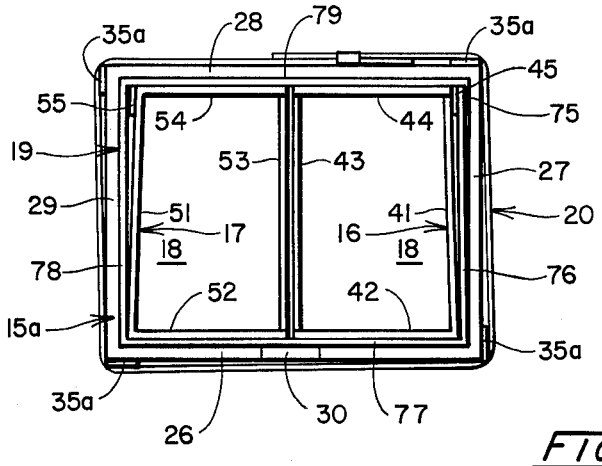
FIG. 13 shows the lower tray formed and interlocked with the lower ends of the liner tubes and with a band tieing the interlocked structure together.

In FIGS. 11 to 13, some of the steps of assembling the various units of the container are illustrated schematically. In these Figures, the upper flaps of the liners 16 and 17 are shown upstanding for the sake of clarity. The blank for the tray 15 is first disposed flat on a suitable support. The bottom liner pad 18 is then placed flat on the tray blank with its edges in substantial coincidence with the hinge lines 32. Then the two liner shells 16 and 17 are formed into rectangular tubes by folding on vertical score lines 46 and 56 and gluing the respective connector flaps 45 and 55 to the outer surfaces of the adjacent sidewall panels 41 and 51. They are then placed upright as indicated in FIG. 11, in side-by-side relationship, with their inner walls 43 and 44 in face contact to form a double common wall producing a transverse partition which divides the container into a pair of material-receiving chambers 16*a* and 17*a*, as shown in FIG. 4, which communicate through the opening adjacent their lower ends formed by aligning notches 69 and 71 as shown in FIG. 1*a*. At this time, the various lower flange flaps 41*c*, 42*c*, 52*c*, 51*c*, 54*c* and 44*c* of the liners 16 and 17 are swung outwardly and rest flat on the inner portions of the respective tray flanges 27, 26, 29 and 28 which are still flat. Next, the outer tube or shell 19 is formed by folding the blank of FIG. 10 on the vertical score lines 74 and gluing the connector flap 75 to the adjacent outer surfaces of the sidewall panel 79. The tubular shell is then slipped downwardy over the liner shells 16 and 17 until its lower end rests on the connector sections, 41*d*, 42*d*, 52*d*, 51*d* and 54*d*, of the lower liner flanges 41*c*, 42*c*, 52*c*, 51*c* and 54*c*, respectively, this position being shown in FIG. 12. At this time, the double flanges 26, 27, 28, 29 of the tray blank 15*a* are still flat and project outwardly beyond the liner flanges which have their outer edges at the inner of the respective double hinge lines 34. Next, the double tray flap 26, 27, 28 and 29 are folded upwardly and inwardly into interlocking relationship with the respective liner flanges 42*c*, 52*c*, 51*c*, 54*c*, 44*c* and 41*c*. In this folding operation, each tray flange is folded upwardly about its respective hinge line 32. As the tray flanges are folded upwardly, the corner sections 35 are folded outwardly about the diagonal scores 36 and their scored connections 32 to the respective tray flanges, to produce triangular corner tabs 35*a* which are bent into overlapping relationship with adjacent tab flanges. At the same time, the respective lower liner flange flaps are turned upwardly at their scored hinge joints 49 and 59, with their respective connector sections, which remain horizontal beneath the lower edges of their respective sidewall panels of the outer shell 18 as shown in FIGS. 3 and 4. This will cause the outer portions of the liner flange flaps to be upright with their inner connector insert portions still flat on pad 18. Then, the outer insert portions 33 of the respective tray flanges are turned inwardly and then downwardly, about the double fold lines 34, and are slipped into the grooves between the respective shell sidewall panels and the upstanding portions of the liner flanges. To secure the liner flanges and the tray flanges in this interlocking relationship, the flexible band 20 is tautly drawn around the resulting upstanding flange 15*a* and its ends are connected. The oval slots 37 at the corners 35 provide cradling corner notches into which the band is drawn and will prevent vertical displacement of the band.

As indicated previously, if a cap is to be provided on the container, it may be identical with the lower tray 15. This type of cap is indicated at 21 in the drawings. It will interlock with the top liner flaps in exactly the same manner as the tray interlocks with the lower liner flaps. The upper liner flaps 43*a* and 53*a* will be directly beneath the cap liner pad 18. So that a special cap need not be provided, the depending flange of the cap may even have the dispensing arrangement but this will not be used.

Figure 2:
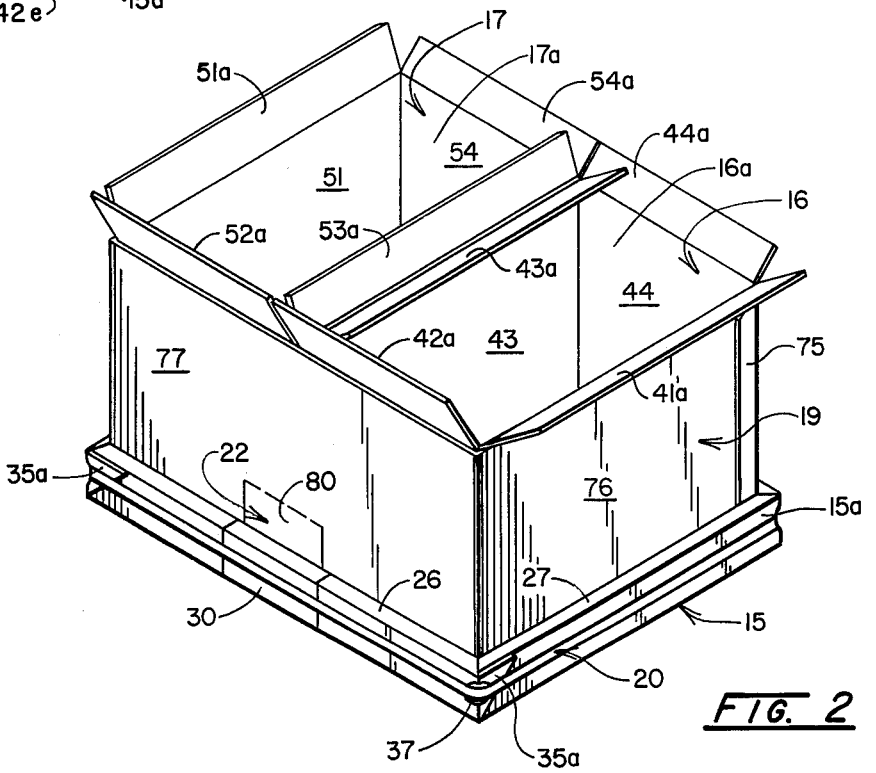
FIG. 2 is a view similar to FIG. 1 with the cap removed which is the condition of the container when it is ready for filling.

The container will be filled when it is in the condition illustrated FIG. 2 and later the cap 21 will be applied in the manner indicated above. The rectangular form of each of the liners 16 and 17 and the outer shell 19 aids in properly positioning these members relatively. The chambers 16*a* anc 17*a* will be in communication at the outer lower corner of the double partition wall 43–53 through the aligning notches 69 and 71, which are adjacent the outwardly-displaceable tab arrangement 22. The transverse double partition will strengthen the container to prevent outward bulging or inward displacement of its sides 77 and 79, since the upper and lower flange flaps of the liners 16 and 17 are interlocked with the bottom tray 15 and with the cap 21 when it is used. The other two sides 76 and 78 will also be prevented from displacement by the upper and lower flange flaps which interlock with the bottom tray and cap.

The outwardly-displaceable tab structure will be normally held in place by the band 20 which is preferbly located, by the corner notches or grooves 37, midway of the height of the upstanding tray flange 15*a*.

It will be noted that the tab 30 is normally upright and its edges 38 are parallel, the tab interlocking with the enclosed tabs 52*e* and 42*e* which together will be of the same lateral extent as the tab 30 so that the outer edges 61 and 62 of the enclosed tabs will align with the edges 38. The next inward tab is the tab 80 of the shell 19 and it will be noted that its vertical edges 81 are parallel but they are not spaced apart as much as the edges 38 and will be offset laterally inwardly relative thereto. The innermost tabs are the meeting liner tabs 63 and 66 and it will be noted that their combined width is less than the width of the tab 80, so that the outer edges 65 and 68 of the pair are out of alignment with the edges 81 of the tab 80. Thus, there are successive vertical walls outwardly from the compartments or chambers 16*a* and 17*a*, these upstanding walls having outwardly displaceable tab arrangements of increased width so that the vertical edges of the successive tabs do not coincide, which results in increased strength. It will also be noted that the hinge line 82 of the tab 80 is out of alignment with the top edges of liner tabs 63 and 66, being spaced above them substantially the thickness of the tab 80.

When it is desired to dispense the contents of the container, the band 20 is pulled downwardly below the tab 30 or the band may be cut and removed. It is then possible to outwardly displace the various tabs of the arrangement 22 to form a dispensing passage leading continuously from both of the chambers 16*a* and 17*a*. To form this passage, the tab 30 is first pulled outwardly into completely extended horizontal position about its hinge line 32, the liner tabs 42*e* and 52 swinging with the tab 30 about their respective hinge lines 49 and 59 into completely extended horizontal position. Next, the tab 80 is swung upwardly and outwardly about its hinge line 82. Finally, the tabs 63 and 66 are swung laterally outwardly about their respective vertical hinge lines 65 and 68 beneath the tab 80 which will be supported thereby. Thus, as shown in FIG. 1*a* there is produced a laterally-leading passageway or spout for dispensing the contents of both of the chambers 16*a* and 17*a*.

The container assembly may be mounted on a solid pallet if desired which is important when it is used for packing heavy small objects, such as coins. The fact that it dispenses laterally from the side rather than the bottom makes this possible. Also, even if a pallet is not used, the container bottom is stronger since no openings are formed in the flat bottom or its overlying liner pad. Also, the side-dispensing is important when the container assembly is used with certain types of machines.

The side-dispensing arrangement, as described above, is in the multiple sidewall which consists of a series of successive vertical walls starting with an innermost wall and ending with an outermost wall, the walls having outwardly displaceable hinged tabs, the tabs having edges out of alignment, the tabs increasing in lateral extent from the innermost wall to the outermost wall.

Having thus described this invention what is claimed is:

1. A container assembly of fiberboard or the like comprising a bottom tray of angular form having a flat bottom wall with an upstanding peripheral flange composed of a number of sides angularly disposed relatively, an upright material-receiving shell disposed within the flange of the tray and having upright side walls disposed inwardly of and adjacent to the sides of the flange, each of said sides of the tray flange being in the form of a double hinged flange consisting of an outer upright section hinged to the flat bottom and an inward depending insert section hinged to the outer section at a double hinge; each of said upright side walls of the shell adjacent the respective sides of the tray flange having a lower flange interlocking with the double hinged flange of the tray and consisting of a lower connector section hinged to the wall and extending outwardly and an upright insert section hinged to the connector section and extending upwardly between the outer upright section of the double hinged tray flange and its inner depending insert section; said interlocking double hinged flange of the tray and flange of the shell at one of said tray flange sides having cooperating outwardly-displaceable tabs to provide a dispensing passageway, when desired, which leads laterally through the tray flange and which comprises:

a tab structure of selected width hinged to the upright wall of the shell for outward displacement and located above said connector section of the wall flange, a tab formed in said inner depending insert section and outer upright section and double hinge of the side of the tray flange and being of no less width than the width of said shell upright wall tab structure to permit outward displacement of said wall tab structure, an outwardly displaceable tab in said upright inner section of the shell wall flange interlocked within the tab of the double hinged tray flange side and being of no greater width than that tab so as not to prevent outward displacement thereof but being of no less width than the shell upright wall tab to permit outward displacement of that tab; outward displacement of the tabs of the shell flange and interlocking tray flange causing outward extension of the tray tab with its double hinged flange horizontal and the tab of the upright insert section of the shell flange into horizontal position overlying it with the shell upright wall tab structure opening over the said overlying flanges; and securing means cooperating with said tray flange tab to maintain it in normal position, and in which an outer shell is provided which surrounds the inner shell that serves as a liner shell, said outer shell having upright side walls with their lower ends disposed within the corresponding sides of the tray flange outwardly of the corresponding side walls of the liner shell and resting on said connector section of the liner shell lower flange:

and an outwardly displaceable tab in the lower end of the outer shell side wall which is located within the side of the tray flange having the outwardly displaceable tab, said outer shell tab being hinged to the outer shell for outward movement and being of no less width than the tab structure of the upright liner shell wall to permit outward displacement of that tab structure and no greater width than the tab of the interlocking tray flange and shell flange to permit outward displacement of the outer shell tab through the opening provided by displacement of the tabs of the interlocking flanges.

2. A container assembly according to claim 1 in which the securing means comprises:

a tie-band extending completely around the upstanding peripheral flange of the tray and located intermediate the height thereof.

3. A container assembly according to claim 1 in which the material-receiving liner shell comprises:

a pair of upright tubular shells each having a plurality of upright side walls, said liner shells being disposed side-by-side with a common double partition wall and with outer side wall sections disposed side-by-side within the outer shell side wall that has the outwardly displaceable tab formed therein; said partition wall extending vertically in a plane substantially at a right angle to said outer side-by-side wall sections and having its lower corner notched to provide a connecting passageway between the two liner shells; the outwardly displaceable tab structure of the material-receiving liner shell consisting of a tab in each of said side-by-side outer side wall sections of the tubular liner shells which are hinged for outward displacement through the opening provided by displacement of said outer shell tab, which have free meeting edges and which have a total width no greater than that of the tab in the outer shell to permit outward displacement through said opening; and said insert tab of the flange of the liner shell consisting of a tab hinged to the insert section of each of said liner wall section flanges and disposed side-by-side within the double hinged tray flange tab, the total width of said side-by-side insert flange tabs being no greater than the width of the enclosing tab of the double hinged tray flange tab so as not to interfere with the outward displacement of that enclosing tab.

4. A container assembly according to claim 2 in which: the outwardly displaceable interlocking tab of the tray flange and insert liner shell flanges are of greater width than the outer shell flange, and the tabs in the upright side-by-side outer liner side walls are of a total width less than that of the tab in the outer shell.

* * * * *

UNITED STATES PATENT OFFICE

CERTIFICATE OF CORRECTION

Patent No. 4,043,502 Dated August 23, 1977

Inventor(s) Thomas E. Croley

It is certified that error appears in the above-identified patent and that said Letters Patent are hereby corrected as shown below:

Column 3; line 35, "panels" to read -- panel --;

line 38, "slot" to read -- slit --.

Column 4; line 41, the word -- insert -- to appear after "outer".

Column 8; line 1, of claim 4, the number "2" to read -- 3 --.

Signed and Sealed this

*Sixth* Day of *December 1977*

[SEAL]

*Attest:*

RUTH C. MASON
*Attesting Officer*

LUTRELLE F. PARKER
*Acting Commissioner of Patents and Trademarks*